US007784452B1

(12) United States Patent
Kronengold et al.

(10) Patent No.: US 7,784,452 B1
(45) Date of Patent: Aug. 31, 2010

(54) ARCHERY BOW SYSTEM

(75) Inventors: David H. Kronengold, Tucson, AZ (US); Allen C. Rasor, Marana, AZ (US); Benjamin D. Blosser, Richland, IN (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 580 days.

(21) Appl. No.: 11/531,912

(22) Filed: Sep. 14, 2006

Related U.S. Application Data

(60) Provisional application No. 60/717,157, filed on Sep. 15, 2005.

(51) Int. Cl.
*F41B 5/00* (2006.01)
*F41B 5/10* (2006.01)

(52) U.S. Cl. ..... 124/23.1; 124/25.6

(58) Field of Classification Search ..... 124/23.1, 124/25.6

See application file for complete search history.

(56) References Cited

U.S. PATENT DOCUMENTS 4,644,929 A * 2/1987 Peck ..... 124/23.1
5,429,106 A * 7/1995 Martin et al. ..... 124/23.1
5,720,267 A * 2/1998 Walk ..... 124/23.1
5,722,380 A * 3/1998 Land et al. ..... 124/25.6
6,371,098 B1 * 4/2002 Winther ..... 124/23.1
6,786,214 B2 * 9/2004 Andrews ..... 124/23.1

* cited by examiner

*Primary Examiner*—John Ricci
(74) *Attorney, Agent, or Firm*—Cahill Glazer PLC

(57) ABSTRACT

An archery bow system incorporating a bow riser and dual limbs supporting cams or a cam and wheel mounted for rotation about respective axles. The dual limbs are independently adjustable to correct for cam lean and are individually supported in pockets that incorporate variable limb angle attachments to the bow riser. The limbs extend from the riser to flex, when at full draw, to positions that cause the respective axles to initially travel rearward toward the archer upon release of the bowstring. The limbs are adjustably attached to the riser to permit the limb angle with respect to the riser to be changed.

8 Claims, 5 Drawing Sheets

ARCHERY BOW SYSTEM

CROSS-REFERENCE TO RELATED APPLICATION

This application is related to and claims priority to a provisional Application entitled "ARCHERY BOW SYSTEM" filed Sep. 15, 2005 and assigned Ser. No. 60/717,157.

FIELD OF THE INVENTION

The present invention relates to archery bow systems and particularly to archery bows incorporating adjustability features to permit archers to correct cam lean, adjust limb angle and change bow geometry.

BACKGROUND OF THE INVENTION

Compound bows inherently suffer from cam lean as a result of a number of factors such as side loads produced by cable guards, inconsistency of limbs, and varying loads on different tracks of cams. Cam lean is a disadvantage to the archer because of the possibility of strings derailing from their tracks during use. Also, excessive lean will tend to prematurely cause string failure and cable wear. The present invention incorporates dual limbs and independent dual limb adjustments which lead to the ability to control wheel lean and minimize string and cable wear. The independent dual limb adjustment has two separate limb containment devices. There is a means for adjusting the limbs independently, and it may be possible to modify to adjust both limbs in unison. The adjustment will either increase or decrease the draw weight of the bow. Also, if one of the limbs is adjusted independently of the other, it will cause the cam to lean one way or the other. The cams can thus be adjusted to provide the strings with a straight path to follow in their respective grooves. Further, the dual limbs permit the mounting of the axle for the cam to be positioned closer to the riser, thus enabling the utilization of shorter limbs and larger cams.

The limbs are also mounted for a variable limb angle so that not only may the tension or draw weight of the bow be changed, but the actual limb geometry may be changed. That is, it is possible to have the same limb tension but different limb positions. Changing the limb angle will change the geometry of the bow and will change the axle-to-axle length. This adjustable limb angle is not accomplished with the usual limb bolt (that is still provided to adjust draw weight) but by multiple fixed positions determined by the mounting holes in the riser and a positioning pin for securing the limb pockets in a predetermined angular position with respect to the riser. Modifying the bow geometry by positioning the limbs at a greater angle with respect to the riser gives the bow a better feel to the archer. Further, this positioning of the limbs raises the brace height and gives the bow better performance, usually in the form of a smoother launch of an arrow. Importantly, the archer has the ability to completely change the bow by adjusting the pockets, changing strings and cable, and still have the bow exhibit the same peak weight and draw length. This versatility is provided without the utilization of professional help and special equipment such as a bow press.

An important feature is the fact that the limbs can be positioned such that when the bowstring is at full draw, the axle of the respective cam or wheel is drawn toward the center of the riser, and may be drawn beyond parallel with respect to each other or beyond a horizontal reference line drawn from the respective axle to corresponding pivot point of each limb. When this geometry is chosen, the release of the bowstring will result in the arcuate travel of the axle of the wheel and cam that initially has a significant component of reaction force that is directed forward, or away from the archer. This initial force results in a smoother release; the initial reaction of the bow resulting from the release is less noticeable to the archer as with previous bow configurations. The stored energy expended during the release is now more balanced and is directed up and down as the axles of the cam and wheel first travel rearward toward the archer and then upward as the arcuate travel of the axles pass through horizontal and end with forward travel at the end of the release. Thus, the "feel" of the reaction force as detected by the archer during release is smoother and with a lower amplitude.

The utilization of independent dual limbs avoids limb fatigue and possible failure as a result of twisting moments caused by large cam profiles with strings or cables entering or exiting their respective tracks out of the plane of the cam. The independent dual limbs are each independently adjustable to accommodate such uneven forces.

The utilization of a ratio of approximately 0.22 or less limb length (measured from limb pivot to axis of the cam/wheel axle) to riser length (measured from limb pivot to limb pivot) provides several manufacturing advantages. The riser can be manufactured from bar stock instead of an expensive extrusion because the length of an extrusion to provide the above ratio would be extremely expensive. Further, the riser length accepts shorter limbs that can be angled with respect to the riser to provide a high brace height. The low ratio provides for longer risers and shorter limbs that may be angled backwardly toward the archer and permit the mounting of cams/wheels such that at full draw, the axles of the cam/wheel follow an arcuate path to positions where the respective limbs are parallel and ultimately beyond parallel. Upon release, the axles and the respective wheel/cam travel rearward toward the archer to provide an initial reaction force opposite to that experienced with conventional riser limb cam axle configurations.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1A:
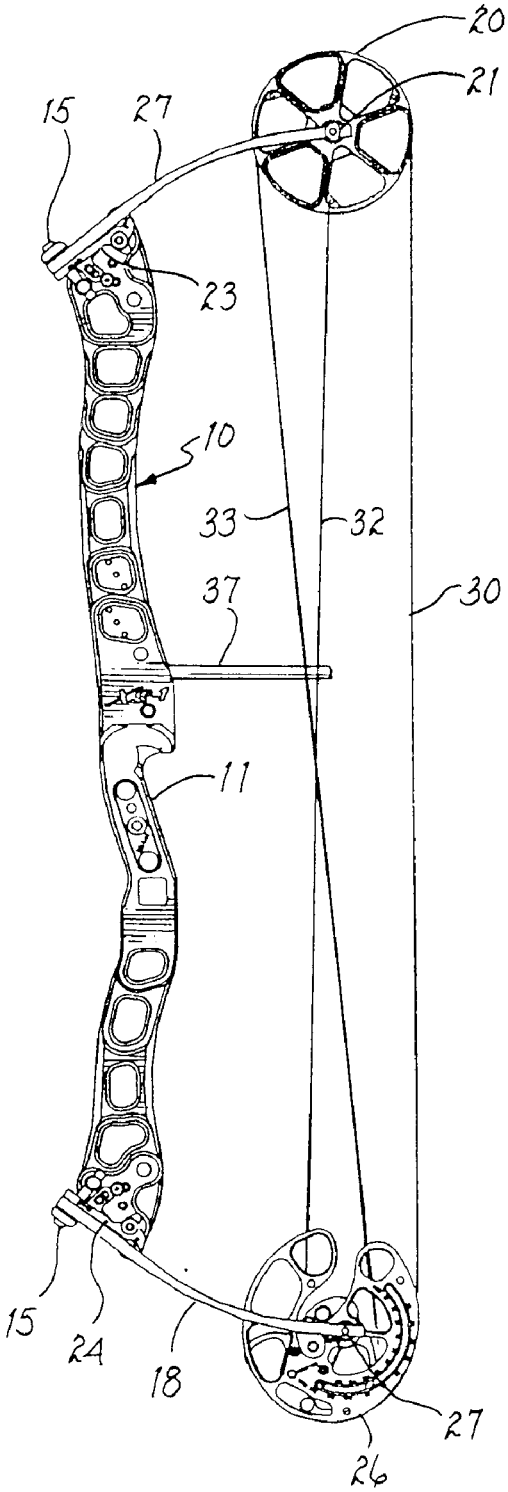
FIG. 1A is a side elevational view of an archery bow system constructed in accordance with the teachings of the present invention.
Figure 1B:
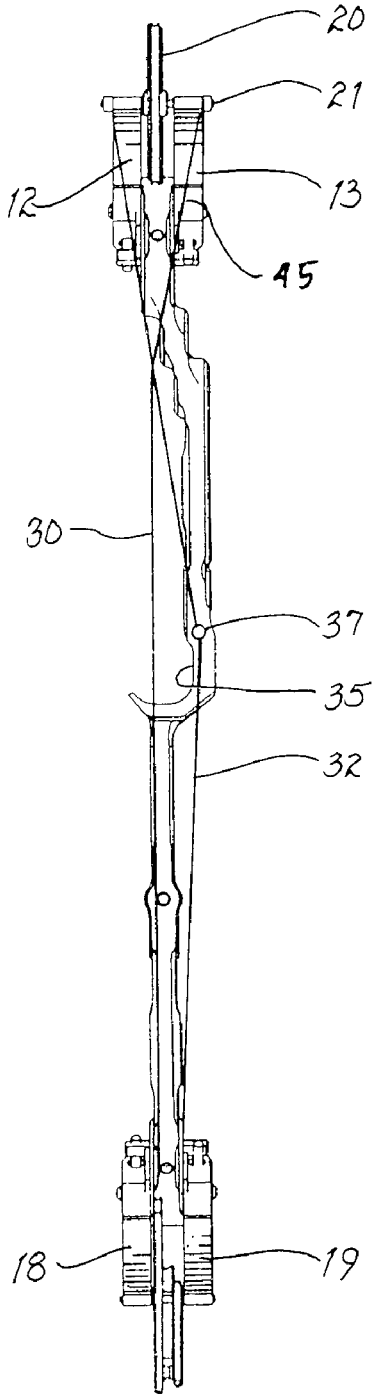
FIG. 1B is a rear elevational view of the archery bow system of FIG. 1A.

Referring to FIGS. 1A and 1B, a side elevational view and a rear elevational view of an archery bow system constructed in accordance with the teachings of the present invention as shown. The bow system includes a handle or riser 10 constructed of aluminum or other rigid material and may incorporate a grip portion 11 that may conveniently be formed to accept the palm of the shooter's hand. In practice, the grip portion 11 would normally be encased in a wood, rubber, or other formed material to conform to the shape of a shooter's palm. The upper end of the riser 10 provides support for a pair of upper flexible resilient limbs 12 and 13 clamped to the riser 10 by corresponding limb bolts such as bolt 15. The limbs 12 and 13 extend rearwardly toward the archer and support a wheel 20 mounted for rotation about a wheel axle 21. At the lower end of the riser 10 a pair of flexible resilient limbs 18 and 19 are secured to the riser through the utilization of limb bolts 15. The upper limbs 12 and 13 and the lower limbs 18 and 19 are supported by the riser 10 through the utilization of limb pockets or brackets 23 and 24, the details of which will be described more fully hereinafter. The lower limbs 18 and 19 support a cam 26 mounted for rotation about a cam axle 27. A bowstring 30 extends from the cam 26 and circumscribes the wheel 20 to return to the cam 26 to be anchored thereon. A cable 32 extends from around a cable groove provided in the cam 26 to be anchored to the wheel axle 21. The operation of the bowstring cable wheel and cam are well known to those skilled in the art and need not be described here. The principles of the invention are applicable to bow systems whether they use a single cam with a wheel or use dual cams. The riser 10 may include an offset 35 to provide clearance for arrow fletching as it is forced by the bowstring past the riser. It may be noted that a cable guard 37 extends rearwardly of the riser 10 toward the archer to laterally displace the cable 32 and the bowstring return 33 to ensure clearance in the plane of the bowstring 30 as the latter is drawn from its rest position shown in FIGS. 1A and 1B to its full drawn position. In this manner, the motion of the bowstring as it is released permits the arrow to be propelled without interference from either the bowstring return or the cable.

It will be appreciated that the cable 32 and the bowstring return 33 are forced out of the plane of the corresponding wheel and cam tracks by the cable guard 37; this side loading, particularly of large cams that may have a significant side loading caused by the distance from a cam axle to the peripheral point of contact of the cable will cause the cam to lean and exert a torsional force on a supporting limb. In extreme cases, such cam leaning can result in the derailing of bowstrings from their tracks. Further, such cam leaning will prematurely cause bowstring failure and cause cable wear. Torsional stresses experienced by prior art single upper and lower limbs can create stress fractures and ultimate failure of the respective limbs. Cam lean can also be caused by the varying loads on different tracks provided in the cams or, in the case of single upper and lower limbs, imperfections or inconsistency of limb characteristics.

The present invention utilizes dual limbs 12 and 13 for the upper, and dual limbs 18 and 19 for the lower supports for the wheel and the cam, respectively. Each of the individual limbs is independently adjustable to enable the archer to adjust each limb independently to control wheel lean and thereby minimize string and cable wear. When the individual limbs have been adjusted, the strings are provided with a straight path to their respective grooves; further, the use of dual limbs permits the axles of the respective cams and wheels to be mounted closer to the riser; that is, unlike prior art limbs and cam combinations, the dual limbs supporting the cam provide free space therebetween to permit the cam axle to be positioned closer to the riser and to permit a larger cam to be used. Further, although larger cams in the prior art would have resulted in greater twisting or torsional force imparted to the limb, the utilization of dual limbs, each independently adjustable, permits the larger cam and also permits the cam to be positioned closer to the riser. Among the many advantages of thus positioning the cam closer to the riser is the fact that the brace height may be reduced.

Figure 2:
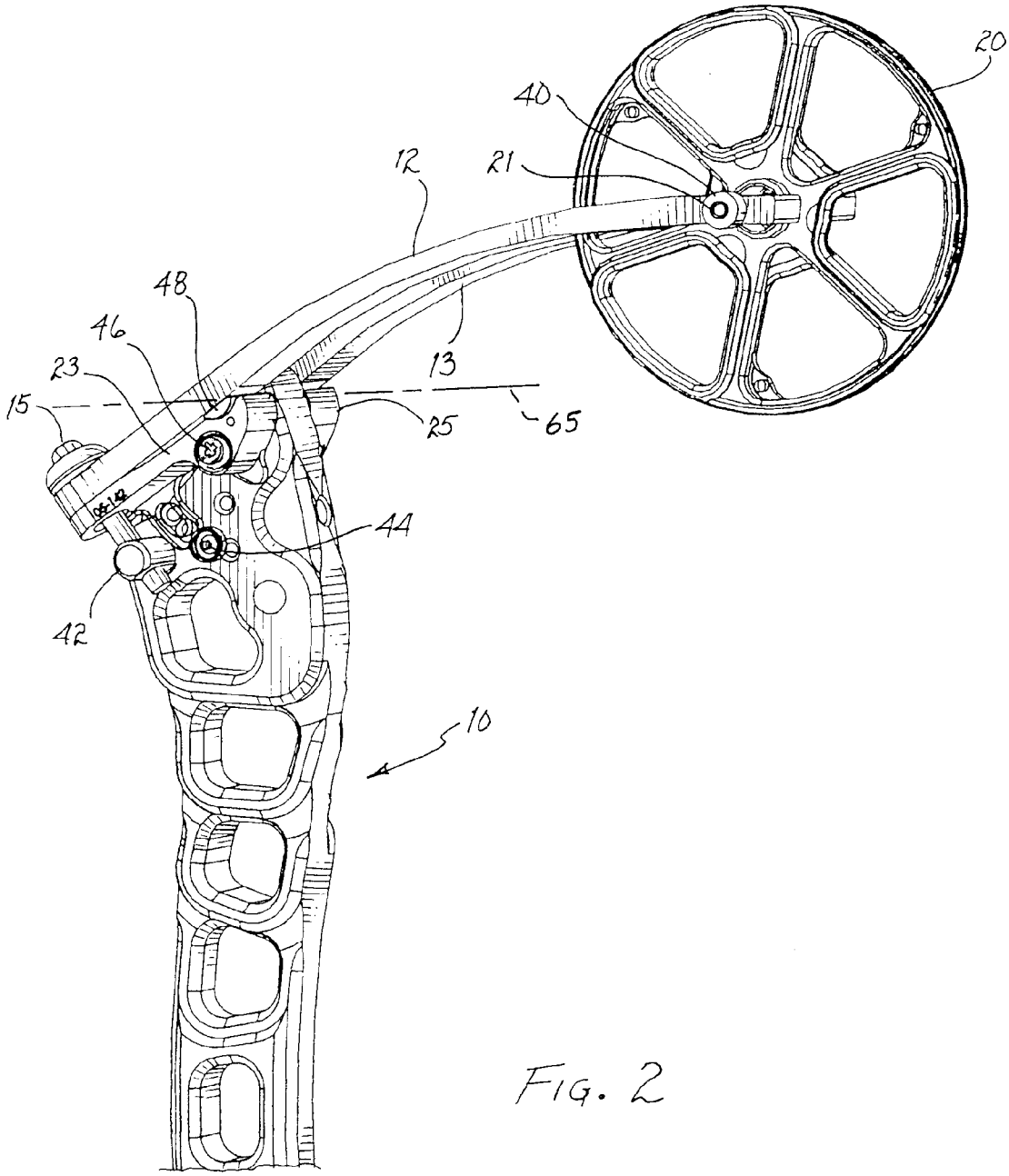
FIG. 2 is an enlarged prospective view of the upper portion of the bow of FIGS. 1A and 1B showing the wheel mounting structure.

Referring now to FIG. 2, an enlarged perspective view of the upper portion of the bow shown in FIGS. 1A and 1B is shown. FIG. 2 is shown without the cable guard, bowstring and cable to facilitate the description of the system. The upper portion of the riser 10 supports dual limbs 12 and 13 extending therefrom to which wheel 20 is mounted. The wheel 20 is mounted for rotation about the wheel axle 21; the ends of the axle are capped by thimbles 40 that receive and anchor the split ends of the cable 32. The split ends of the cable are shown at 45 in FIG. 1B. The limbs 12 and 13 are mounted in limb pockets 23 and 25, respectively. The pocket 23 is secured to the riser 10 by a socket cap screw 46 and by the limb bolt 15 passing through the limb 12 to threadedly engage the limb bolt anchor 42. The force applied to the wheel axle 21 caused by the tension in the bowstring and by the tension in the cables applied to the thimbles 40 tend to flex the limb 12 about a pivot point defined by a half-round 48 (to be described more fully hereinafter) engaging a corresponding mating surface in the limb pocket 23. The tension applied to the bowstring through the wheel 20 may be adjusted by threadedly rotating the limb bolt 15 clockwise (to increase the bowstring tension) or counterclockwise (to decrease the bowstring tension). An identical limb bolt is provided for the limb 13 which is also mounted in an upper limb pocket 25. Thus, rotating the limb bolts for the limbs 12 and 13 adjusts the force with which the limbs counter the tension in the cable and bowstring. Since the limbs 12 and 13 support opposite ends of the wheel axle 21, the orientation or "tilt" of the axle, and thus the wheel 20 may be modified.

Figure 3:
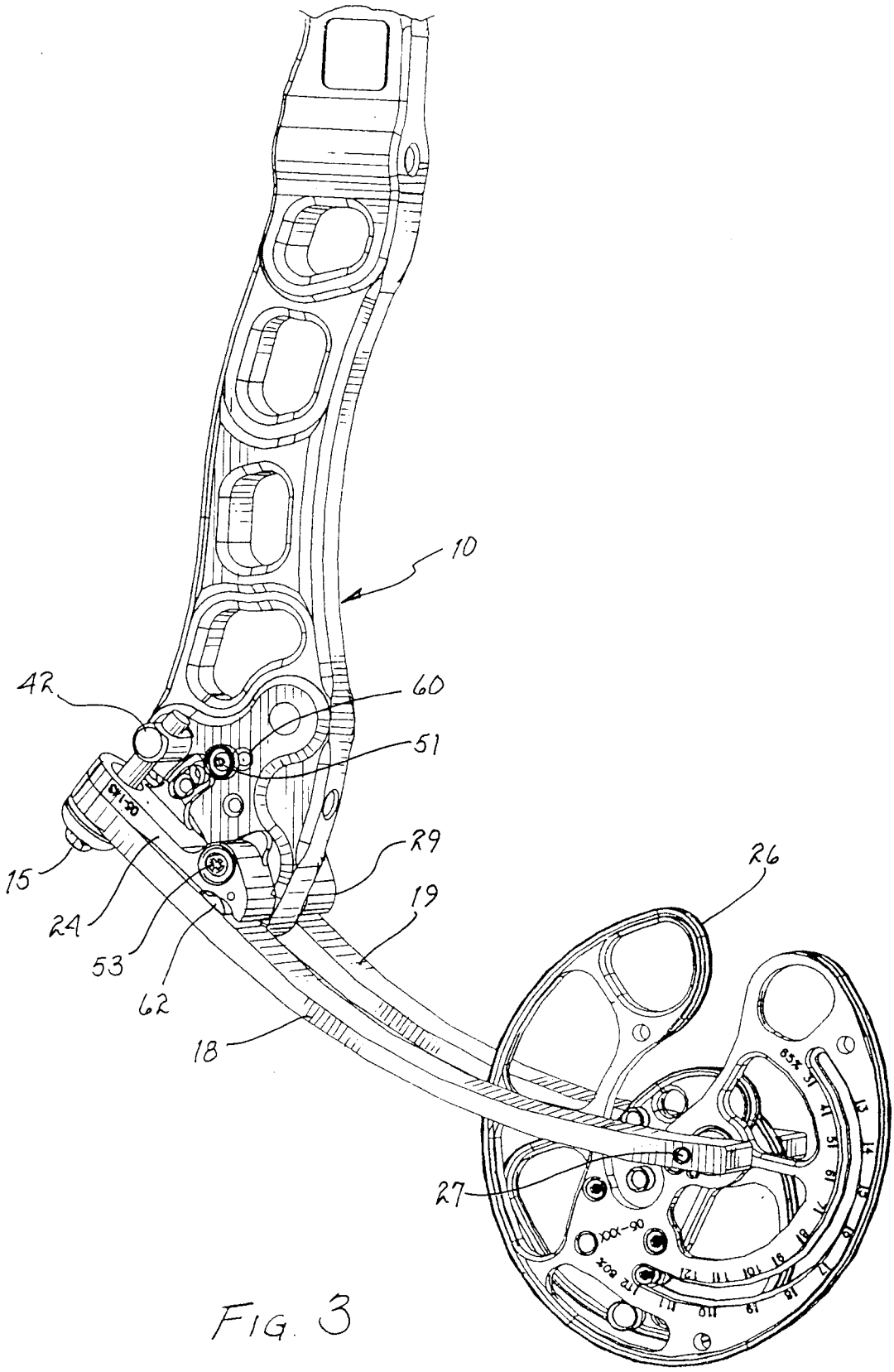
FIG. 3 is an enlarged perspective view of the lower portion of the bow of FIGS. 1A and 1B showing the cam mounting structure.
Figure 4:
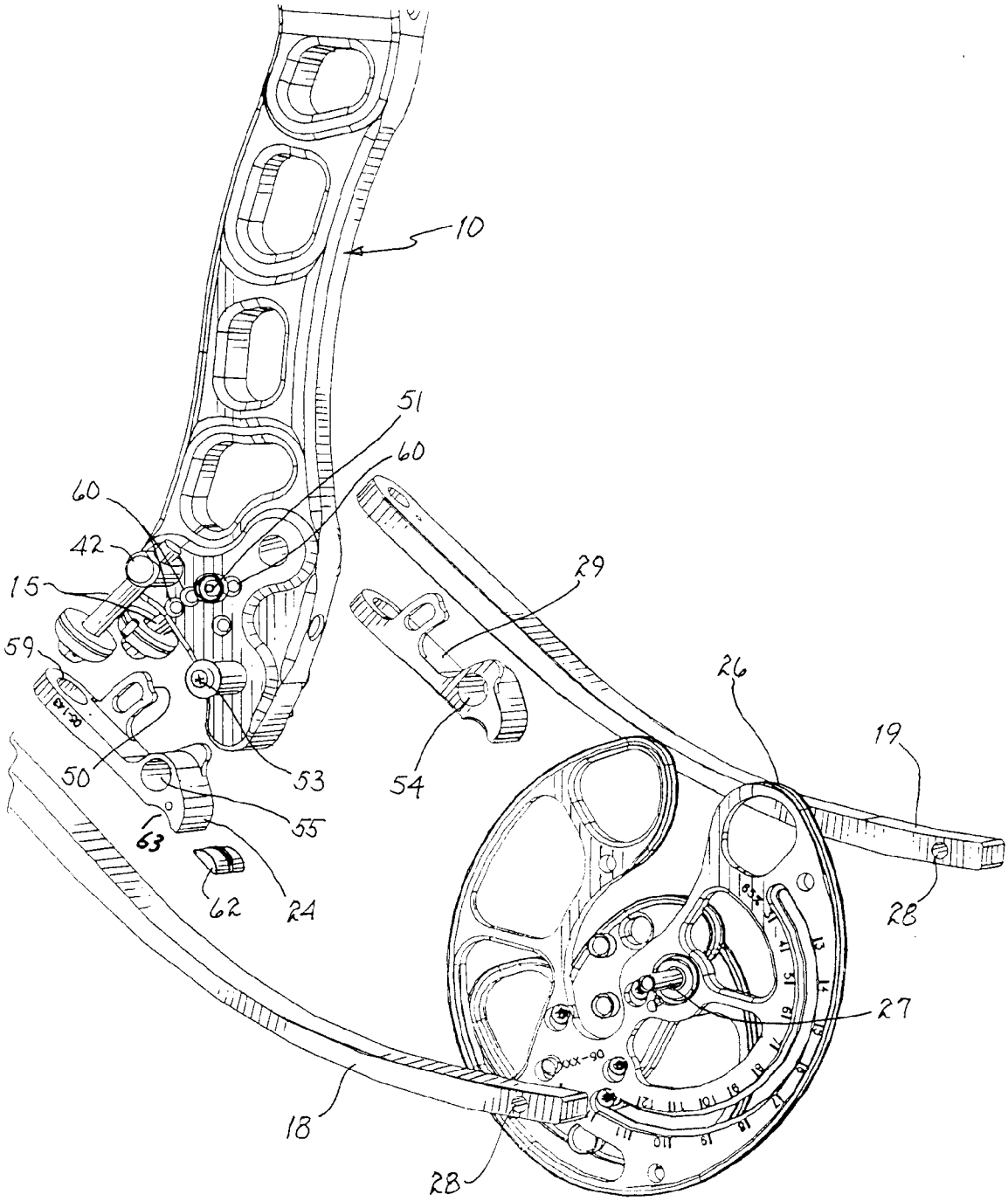
FIG. 4 is an exploded view of the structure shown in FIG. 3.

Referring to FIGS. 3 and 4, an enlarged lower portion of the bow system of FIGS. 1A and 1B is shown in perspective view. FIG. 4 is the structure of FIG. 3 in exploded form to facilitate the description thereof. The lower portion of the riser 10 supports the cam limbs 18 and 19 in a manner similar to that described above for the upper portion of the riser. The cam limbs 18 and 19 are supported by pockets or brackets 24 and 29, respectively, while limb bolts 15 extend through limb bolt holes 59 in the limbs 18 and 19 as well as the pockets 24 and 29. The limb bolts 15 thus clamp the respective limbs to the end of the riser 10 and in intimate contact with their respective pockets. The pockets in turn are secured to the riser by socket cap screws such as cap screw 53 that extends through the corresponding pocket pivot socket 55 to thus permit the pocket 24, for example, to pivot about the cap screw 53. When in position, the pockets 24 and 29 are clamped by the limb bolts 15 that extend through the corresponding limbs through the pockets to threadedly engage limb bolt anchors 42. The pocket 24 incorporates a pin contact 50 which abuts a positioning pin 51. The positioning pin 51 threadedly engages a selected one of a plurality of positioning pin threaded holes 60 provided in the end of the riser 10.

The cam limbs 18 and 19 thus extend from the end of the riser 10 parallel to each other to support a cam axle 27 extending through axle holes 28 provided in the ends of the limbs. The cam 26 is rotatably mounted on the axle 27. When assembled, each of the cam limbs 18 and 19 may be flexed by the force of the bowstring and cable (not shown in FIGS. 3 and 4). The flexing of the limbs forces a corresponding half-round, such as half-round 62, into engagement with a corresponding rounded surface 63 of the pocket 24. The half-round provides a cylindrical surface, and thus a pivot axis 65, about which the respective limb may flex in response to forces applied by the bow system cable and bowstring. The angle at which the cam limbs extend away from the riser 10, when at rest or in an undrawn position, may be adjusted by positioning the pocket positioning pins, such as pin 51 in a selected one of the positioning pin threaded holes 60 in the riser 10. Such adjustment provides an adjustable limb angle that is not accomplished by usual limb bolts found in the prior art. Changing the position of the corresponding positioning pins changes the geometry of the bow system and will accommodate different string and cable combinations. It is possible to select a positioning pin 51 position that will result in a longer or shorter axle-to-axle length between the wheel and cam but nevertheless can be adjusted to provide the same draw weight of the bow. In the embodiment chosen for illustration, three positioning pin threaded holes 60 are shown provided in the riser 10. More or fewer holes may be provided or the holes may be replaced with a machined slot to thereby provide infinite variability in the positioning of the corresponding pocket and limb.

Since the cam limbs 18 and 19 are individually attached to the riser 10 with each having its own limb bolt adjustment means, the twisting or torque applied to the cam 26 as a result of the cable guard or cam groove configurations may be countered by selectively tightening or loosening the limb bolts of the individual limbs to compensate for cam lean.

Figure 5:
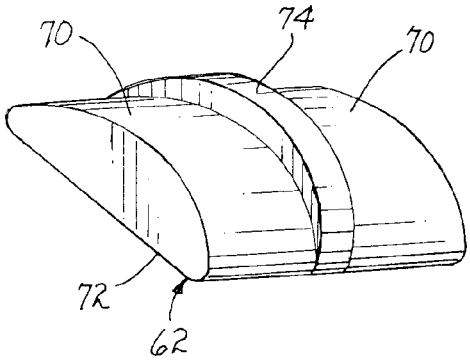
FIG. 5 is a perspective view of the half-round of used in the bow system of the present invention.

The half-round 62 is shown in greater detail in FIG. 5 wherein it may be seen that the cylindrical surfaces 70 are provided to engage corresponding surfaces in the limb pocket, such as pocket 24. The lower flat surface 72 contacts the corresponding limb. The half-round may be made of any suitable rigid material such as glass filled polycarbonate and is provided with a rib 74 that fits into a groove provided in the pocket. The half-round 62 is thus maintained in position between the corresponding limb and pocket by the force of the limb acting on the surface 72; the half-round is free to rotate in the corresponding pocket as the limb is flexed while the rib 74 maintains the half-round in lateral position.

Figure 6:
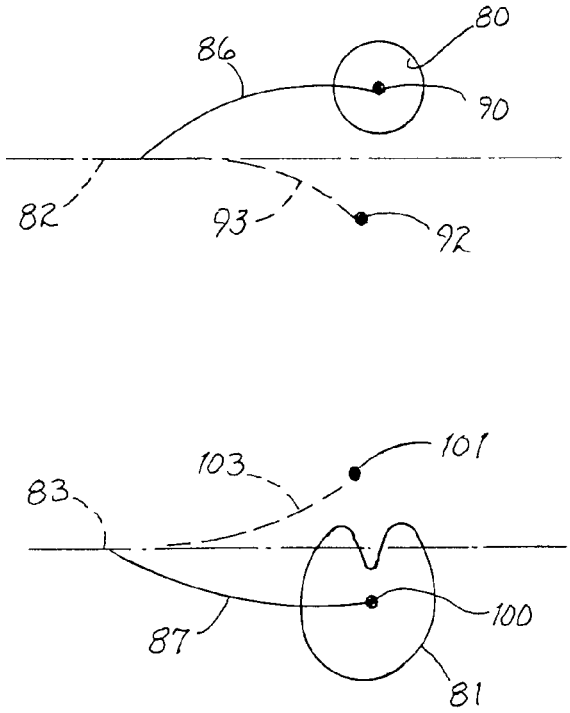
FIG. 6 is a schematic representation of the bow limb, wheel and cam movement during the launch of an arrow.

Referring to FIG. 6, a schematic representation of the bow limb, wheel and cam movement during the launch of an arrow is shown. The schematic representation of the wheel 80 and the cam 81 is shown as they would exist when the bow is in a rest position. Horizontal reference lines 82 and 83 are drawn with respect to the wheel and cam, respectively. As used herein, and to facilitate the description, reference is made to horizontal reference lines; further, it is assumed that the riser is being held in a substantially vertical position during the arrow launch. The reference lines need not be horizontal, particularly if the riser is not being held vertically. The reference lines are drawn from the respective pivot mounted on a riser about which the limbs would flex. Thus, the wheel is shown supported by its corresponding limb or limbs 86 and the cam is shown supported by its corresponding limb or limbs 87. As the bowstring is drawn and the respective limbs 86 and 87 are flexed, the rotational axis 90 of the wheel is forced to the position shown at 92. The limb or limbs 86 are shown in the flexed position at 93. Similarly, the rotational axis 100 of the cam 81 is forced to the position shown at 101 and the limb 87 is flexed to the position shown at 103. Thus, the position of the wheel and cam axis 90 and 100, respectively, are shown at the full draw position wherein it may be seen that the respective flexed limbs 93 and 103 are flexed beyond where they are approximately parallel to each other to positions beyond the corresponding horizontal reference lines 82 and 83, respectively. When the bowstring and arrow is released, and the flexed limbs spring back to their original stationary positions, the rotational axis of the cam and wheel travel through an essentially arcuate path as best shown with reference to FIG. 7A.

Figure 7B:
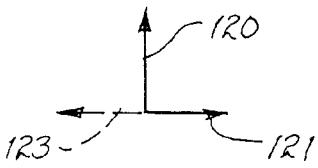
FIG. 7B is a vector diagram representing the motion and reaction force resulting from the movement of the wheel during bowstring release.
Figure 7A:
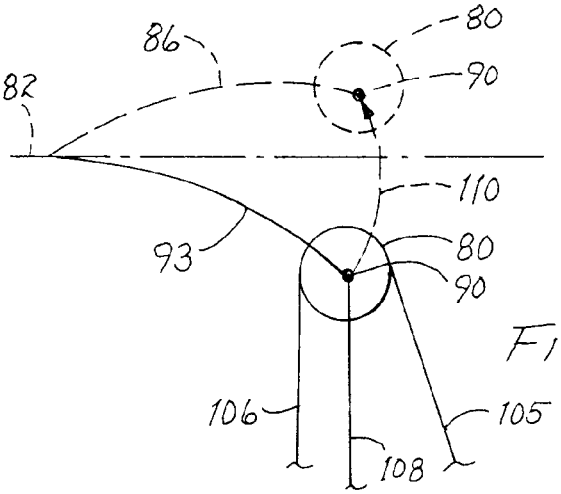
FIG. 7A is a schematic representation of the wheel of the bow system shown in alternate positions as the bow is released.

Referring to FIG. 7A, the wheel 80 and rotational axis 90 is shown with the limb 86 in its flexed position 93. The flexing of the limb 86 is a result of the tension applied on the bowstring 105 as the latter is drawn to full draw by the archer. Further, the additional tension in the bowstring return 106 and the cable 108 results in the flexing of the limb to the position shown at 93. When the bowstring is released the rotational axis 90 of the wheel 80 returns to its original stationary position by traveling the essentially arcuate path 110. It may be noted that this arcuate path begins at a position that is below the horizontal reference line 82 and ends at the wheel's stationary position above the horizontal reference line 82. The initial motion of the rotational axis 80 when the bowstring 105 is released may be represented by velocity vectors 120 and 121 shown in FIG. 7B. It is important to note that the travel of the rotational axis 90, and thus wheel 80, is upward with a significant component 121 directed to the rear of the bow riser; that is, toward the archer and away from the riser. The resulting reaction force caused by the motion and acceleration of the mass of the wheel and relevant limbs is shown by the force vector 123. Thus, this reaction force is opposed to the reaction force that results from the acceleration of the arrow and bowstring during the arrow release. FIGS. 7A and 713 are schematic representations of the motion of the wheel; a similar schematic representation may be made for the cam. Thus, both the cam and wheel travel in an essentially arcuate path during the bowstring release and each provide a reaction force that opposes the reaction force caused by the release of the bowstring and arrow. This reaction force, represented for the wheel by vector 123 in FIG. 7B decreases as the wheel and cam pass through the respective horizontal reference lines and then reverses as the wheel and the cam assume their undrawn or stationary positions. The result of this reaction force is the reduction of the initial "felt" reaction detected by the archer during the initial release of the arrow and presents a smoother arrow release and a lowered reaction force amplitude. The stored energy of the drawn bow and flexed limbs is thus expended as the cam and wheel essentially travel up and down with the first portion of the travel rearward and then upward as the cam and wheel pass through the corresponding horizontal reference lines and subsequently forward to their original rest or stationary positions.

It has been found that a limb/riser ratio of substantially 0.22 or less provides unexpected advantages. The length of the limb, measured from the limb pivot axis 65 (FIG. 2) to the axle 21 divided by the length of the riser, measured from the limb pivot axis 65 of the wheel 20 to a corresponding limb pivot axis of the cam, defines the ratio. By using this ratio, the riser can be manufactured from bar stock, and because of its length, can accept shorter limbs that are therefore angled with respect to the riser to provide a high brace height. This ratio provides for long risers and short limbs that may be angled backwardly toward the archer to facilitate the mounting of the cams/wheels to provide the unique arcuate axle travel as described above.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. For example, the invention has been described by reference to a single cam bow; the same principles of the invention may be applied to dual cam bow systems. It will be apparent to those skilled in the art that modifications may be made in the embodiments chosen for illustration without departing from the spirit and scope of the invention.

We claim:

1. In an archery bow, the improvement comprising:

(a) a riser having first and second ends;

(b) a pair of limb pockets pivotally attached to one of said ends; and (c) a pair of flexible limbs each secured to one of said limb pockets respectively, each limb and its respectively secured limb pocket independently and adjustably secured to said one end to flex about a pivot axis.

2. In an archery bow, the improvement comprising:

(a) a riser having first and second ends;

(b) a pair of limb pockets pivotally attached to one of said ends;

(c) a pair of flexible limbs each secured to one of said limb pockets respectively, each limb and its respectively secured limb pocket independently and adjustably secured to said one end to flex about a pivot axis; and (c) a wheel or cam mounted between the pair of limbs for rotation about an axle;

whereby independent adjustment of the flexible limbs and its respectively secured limb pocket permits modification of a tilt or orientation of the axle and thus the wheel or cam.

3. In an archery bow, the improvement comprising:

(a) a riser having first and second ends;

(b) a pair of flexible limbs secured to one of said ends;

(c) each limb independently and adjustably secured to said one end to flex about a pivot axis; and (d) each flexible limb independently secured to said riser end by a limb bolt, each limb flexing about a pivot axis to apply a force in response to tension in a bowstring and tension in a cable, said force being independently adjustable in each flexible limb, respectively, by rotating a respective limb bolt.

4. In an archery bow, the improvement comprising:

(a) a riser having first and second ends;

(b) a pair of flexible limbs secured to one of said ends;

(c) each limb independently and adjustably secured to said one end to flex about a pivot axis;

(d) a wheel or cam mounted between the pair of limbs for rotation about an axle; and (e) each flexible limb independently secured to said riser end by a limb bolt, each limb flexing about a pivot axis to apply a force in response to tension in a bowstring and tension in a cable, said force being independently adjustable in each flexible limb, respectively, by rotating a respective limb bolt;

whereby, independent adjustment of the flexible limbs permits modification of a tilt or orientation of the axle and thus the wheel or cam.

5. An archery bow system comprising:

(a) a riser having first and second ends;

(b) a pair of limb pockets pivotally attached to one of said ends;

(c) a pair of flexible limbs each secured to one of said limb pockets respectively, each limb and its respectively secured limb pocket independently and adjustably secured to said one end to flex about a pivot axis;

(d) a cam or wheel mounted for rotation about an axle secured to each pair of said limbs;

(e) a bowstring extending between said cam and cam or wheel and a cable extending between a cam and a flexible limb on an opposite end of said riser; and (f) each limb of said pair of limbs and its respectively secured limb pocket independently and adjustably secured to an end of said riser to flex about a respective pivot axis.

6. The archery bow system of claim 5 wherein each flexible limb is independently secured to said riser end by a limb bolt, each limb flexing about a pivot axis to apply a force in response to tension in the bowstring and tension in the cable, said force being independently adjustable in each flexible limb, respectively, by rotating a respective limb bolt.

7. In an archery bow system, a method for modifying the tilt of an axle comprising:

(a) providing a riser having first and second ends;

(b) providing a pair of limb pockets pivotally attached to one of said ends;

(c) providing a pair of flexible limbs each secured to one of said limb pockets respectively, each limb and its respectively secured limb pocket independently and adjustably secured to said one of said ends by a limb bolt;

(d) providing a wheel or cam mounted between the pair of limbs for rotation about an axle; and (e) selectively modifying the tilt of the axle by rotating a selected limb bolt.

8. In an archery bow system, a method for reducing cam lean comprising:

(a) providing a riser having first and second ends;

(b) providing a pair of flexible limbs secured to one of said ends, each limb independently and adjustably secured to said one of said ends by a limb bolt;

(c) providing a cam mounted between the pair of limbs for rotation about an axle; and (d) reducing cam lean by selectively tightening or loosening the limb bolts of the flexible limbs supporting the cam.

* * * * *